US005749681A

United States Patent [19]

Doidge et al.

[11] Patent Number: 5,749,681

[45] Date of Patent: May 12, 1998

[54] HIGH TENSILE STRAND, ANCHORAGES AND METHODS OF INSTALLATION THEREOF

[75] Inventors: Jeffrey Doidge, Cardiff; Terence Cassidy, Sheffield, both of United Kingdom

[73] Assignee: Edgar Allen Engineering Limited, Sheffield, United Kingdom

[21] Appl. No.: 696,974

[22] PCT Filed: Feb. 10, 1995

[86] PCT No.: PCT/GB95/00274

§ 371 Date: Oct. 7, 1996

§ 102(e) Date: Oct. 7, 1996

[87] PCT Pub. No.: WO95/23277

PCT Pub. Date: Aug. 31, 1995

[30] Foreign Application Priority Data

Feb. 25, 1995 [GB] United Kingdom ..... 9403675

[51] Int. Cl.[6] ..... E21D 20/02

[52] U.S. Cl. ..... 405/302.2; 57/217; 405/259.6

[58] Field of Search ..... 405/259.6, 259.5, 405/302.2; 57/217, 218

[56] References Cited

U.S. PATENT DOCUMENTS

| | | | |
|---|---|---|---|
| 3,391,531 | 7/1968 | Riggs | 57/217 |
| 3,705,489 | 12/1972 | Smollinger | 57/217 X |
| 4,289,427 | 9/1981 | Rolston | 405/259.5 |
| 4,333,306 | 6/1982 | Yamashita et al. | 57/216 X |
| 4,606,183 | 8/1986 | Riggs | 57/217 X |
| 4,790,129 | 12/1988 | Hutchins | 405/259.5 X |
| 5,230,589 | 7/1993 | Gillespie . | |
| 5,288,176 | 2/1994 | Huff et al. | 405/259.5 X |
| 5,417,521 | 5/1995 | Scott | 405/259.5 X |

FOREIGN PATENT DOCUMENTS

| | | |
|---|---|---|
| 0 163 479 | 12/1985 | European Pat. Off. . |
| 0 250 010 | 12/1987 | European Pat. Off. . |
| 1067665 | 5/1967 | United Kingdom . |
| 2 080 845 | 2/1982 | United Kingdom . |

*Primary Examiner*—Dennis L. Taylor
*Attorney, Agent, or Firm*—Davis And Bujold

[57] ABSTRACT

A high tensile steel strand for civil engineering applications comprises a core wire (11) and a ring of outer wires (12) arranged in a helical pattern around the core wire and in contact with the core wire. The number and the diameter of the outer wires in relation to the core wire are such that there are significant gaps (13) between adjacent outer wires. The strand is used as an anchorage in rock and a bonding agent between the strand and the rock penetrates gaps (13) to provide effective bonding. The strand is sufficiently flexible to be inserted in deep bores in rock even when surrounding space does not permit straight insertion of the strand.

8 Claims, 2 Drawing Sheets

HIGH TENSILE STRAND, ANCHORAGES AND METHODS OF INSTALLATION THEREOF

The invention relates to high tensile strand for civil engineering applications, to anchorages formed therefrom and to methods of installing such anchorages. The invention is concerned particularly but not exclusively with such installations for use as mine roof support bolts.

One known procedure for supporting mine roofs is to drill a bore in the roof sufficiently far to reach into stable rock, to secure a high tensile mine roof bolt in the bore in the stable rock and to then carry a support plate engaged with the mine roof surface on the outer end portion of the bolt.

All references to rock are intended to include not only sound rock as such but also other ground materials such as clays or loams or coal.

Products known as ground anchors, soil nails and rock bolts operating on broadly similar principles are also used generally in the civil engineering industry. Although the invention is concerned particularly with mine roof support bolts, it could also be applied more generally to these other products.

A problem arises when the distance available below the mine roof is less than the required length of the roof bolt for anchoring it in stable rock.

An objective of the present invention is to provide means whereby this difficulty may be overcome.

It is already known for example from GB-A-2080845 and EP-A-0250010 to manufacture small diameter strand from a core and outer wires with such dimensions that gaps appear between adjacent outer wires of the strand. Such strand is typically used to provide flexible strength in deformable structures such as car tires where a product is manufactured by moulding a product round the strand. Typical diameters mentioned in the prior art are strand diameters of 0.61 mm or 0.65 mm in one case and wire diameters of 0.35 mm or 0.38 mm in the other case. In contrast strand employed in civil engineering applications typically employs much larger diameters of at least 5 mm diameter although wires as small as 4 mm could be satisfactory.

According to a first aspect of the invention a high tensile strand for civil engineering applications comprises a core wire and a ring of outer wires arranged in a helical pattern around the core wire and in contact with the core wire wherein the number and the diameter of the outer wires in relation to the core wire are such that there are significant gaps between adjacent outer wires.

The simplest kind of commercially available steel strand is known as 7-wire strand and incorporates a core wire and six outer wires surrounding the core wire. Theoretically, a 7-wire pattern of this kind with wires of equal diameters would leave all outer wires in intimate contact with the core wire and in intimate contact with adjacent wires. Core contact is more important than contact between adjacent wires, to ensure that when the strand is gripped, the outer wires are engaged firmly against the core wire. For this reason, the diameter of the core wire is generally made at least 2% and typically about 2.5% or 3% larger than the corresponding diameters of the outer wires.

Preferably in accordance with the present invention as applied to 7-wire strand, the diameter of the core wire is between 5% and 50% greater than the corresponding diameter of the outer wires. Alternatively, the number of outer wires may be reduced, for example to 5 and the core wire may then be the same size as or larger or smaller than the outer wires.

Preferably the outer wires have surface deformations.

According to a second aspect of the invention there is provided an anchorage in rock for a high tensile strand as defined above wherein the strand is anchored in a bore in the rock by a bonding agent, wherein the strand fits in the bore with clearance sufficient to permit easy insertion and to allow flow of bonding agent therearound, the bonding agent also being impregnated into the strand into the gaps between adjacent outer wires.

In a typical case, an end portion of the strand adjacent the surface of the rock carries a support plate engaged with the rock surface to support the local rock.

According to a further aspect of the invention a method of installing an anchorage as defined above as a mine roof support when the length of the strand in the rock is greater than the available height of the mine includes the step of feeding the strand into the bore from a generally horizontal position by flexing the strand elastically as it enters the bore.

Embodiments of the invention will now be described by way of example only with reference to the accompanying drawings in which.

Figure 1:
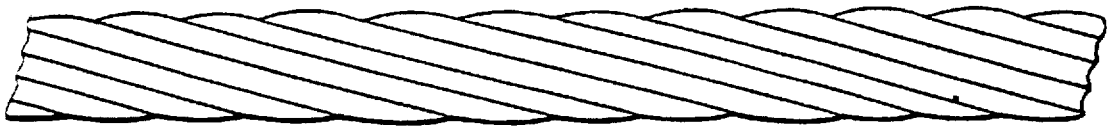
FIG. 1 is a side view of a length of strand in accordance with the invention.
Figure 2:
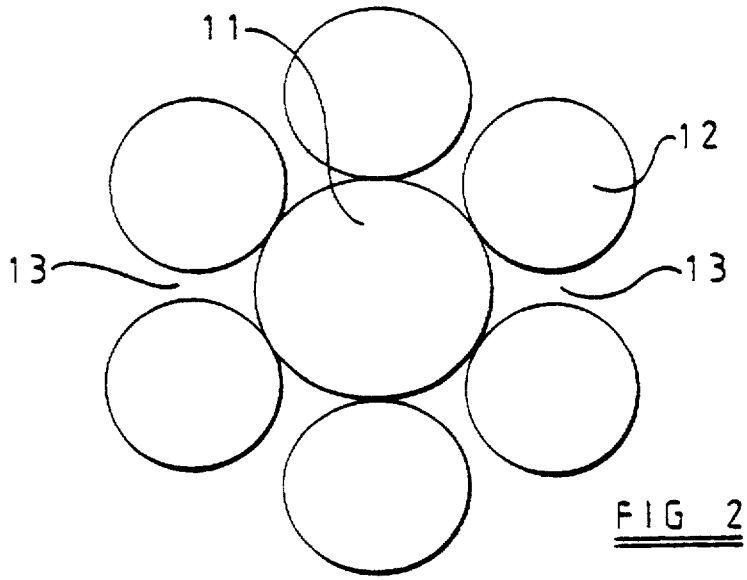
FIG. 2 is a cross section of the strand shown in FIG. 1.

The strand illustrated in FIGS. 1 and 2 is a 7-wire strand having a core wire 11 and six outer wires 12 wound helically round the core wire 11 as shown in FIG. 1. FIG. 2 shows that the individual wires 12 are all in contact with the core wire 11 but that there are gaps 13 between adjacent wires 12. The size of an average gap is controlled by the relative diameters of the six identical outer wires and the larger core wire. The core wire diameter should normally be 5% to 50% larger than the outer wire diameter. The lower limit is defined by a requirement for significant gaps 13 into which bonding material can penetrate as will be explained below. The upper practical limit is defined by the fact that the core wire should not escape into a gap as the strand is bent.

Figure 3:
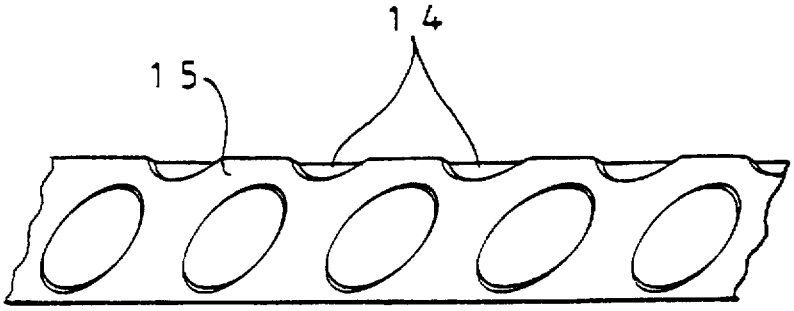
FIGS. 3 and 4 are a side view and transverse section through an outer wire for the strand of FIGS. 1 and 2.
Figure 4:
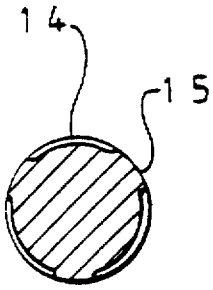

The core wire in this example is a smooth round wire. The outer wires have been subject to surface deformation by rolling shallow indentations in the wire surface as indicated more clearly in the larger scale views in FIGS. 3 and 4 which show a portion of straight wire prior to stranding.

A specific example of strand as described above has a core wire diameter of 8.5 mm and the outer wires (before deformation) of 7.5 mm. Thus the core wire diameter is 13.3% greater than the outer wire diameter and the overall diameter of the strand, ignoring the deformation is 23.5 mm. A typical depth of indentation is 0.15 to 0.2 mm. The lay length or pitch of the helix of an outer wire round the core is 280 mm giving a lay length of about 12 diameters. The strand may be formed with a right or left hand helix.

Suitable choice of high tensile steel wire gives a tensile strength for the strand of 510 KN. A high degree of straightness is required for the bolt and one way of achieving this is to use low relaxation strand.

Figure 5:
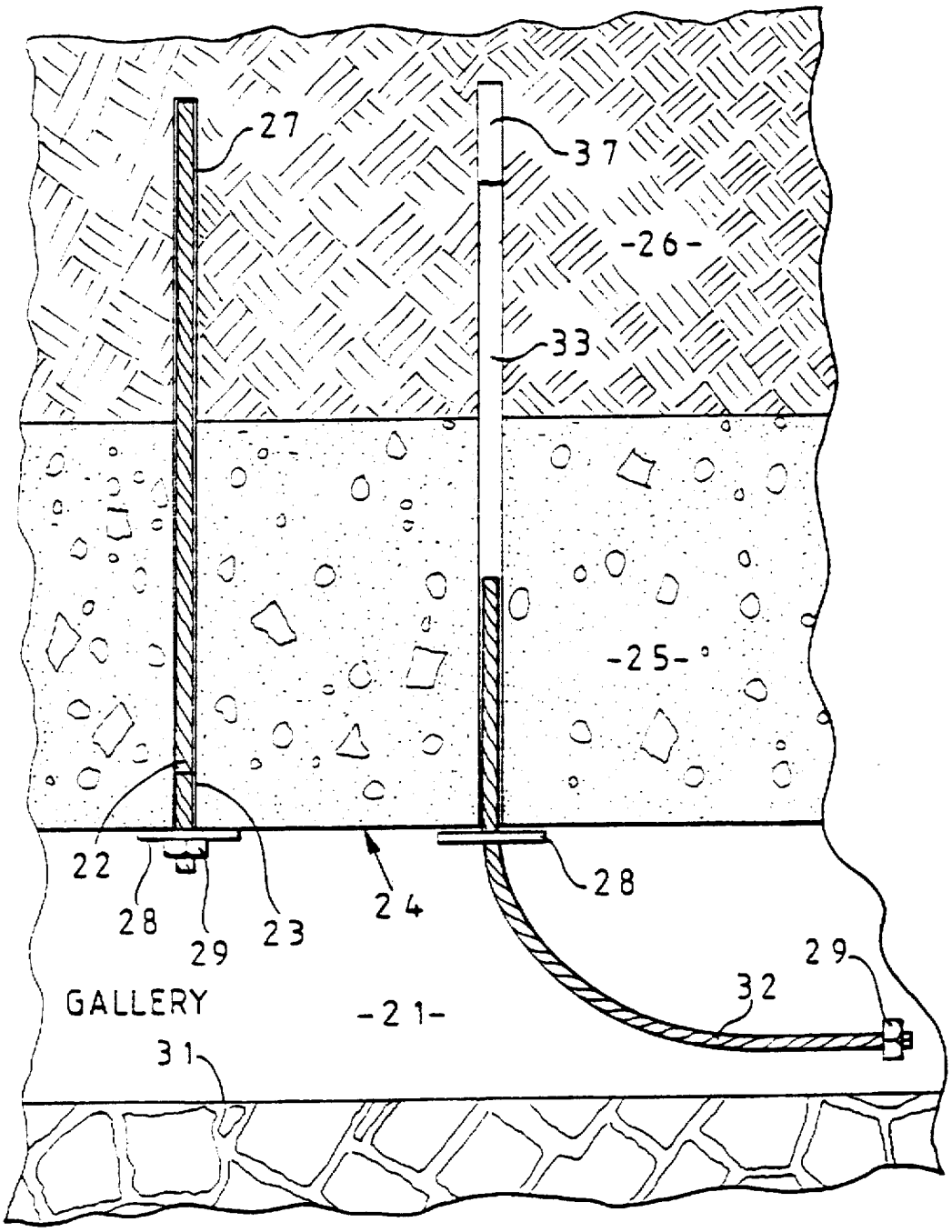
FIG. 5 is a cross section through part of a mine gallery illustrating one mine roof support bolt in position and another being installed.

FIG. 5 is a diagrammatic cross section through a gallery in a coal mine showing roof support for the gallery. The gallery 21 has previously been cut in a coal seam and it is required to support the roof from collapsing into the gallery. Support is provided by mine roof support bolts such as 22. Bolt 22 is based on a length of strand as shown in FIGS. 1 and 2 typically having a length of about 2 to 10 meters. A hexagonal head 29 is secured to one end. In a simple case the head is a hexagonal nut, welded to the strand. Flash butt welding, namely electric welding also involving the application of mechanical pressure, has been found to be the most effective way of securing the head to the strand. The bolt is positioned in a bore 23 extending upward from the gallery roof 24 through rock formations 25 which are unsound or of doubtful strength into sound rock 26. The sound rock may be of a different character from the unsound rock or it may obtain its soundness simply by being further from the gallery 21 so that it has not been disturbed.

The bolt 22 is bonded to the rock over most or all of its length by bonding material 27. A synthetic resin, for example polyester resin, is suitable material. In some situations other resins or other bonding material such as a cement grout may be used. The lower or outer end portion of the bolt 22 carries a roof support plate 28 which is held against the roof 24 by a head 29 secured to the outer end portion of the bolt. In some applications the plate 28 may not be needed because outer regions of the rock may be supported adequately by bonding to the bolt. In such cases the head 29 may be provided merely as an aid to installation.

Clearly bolt 22 could not have been installed in a straight condition due to interference from the floor 31. The mode of installation is shown by a second bolt 32 to be installed in a bore 33. Uncured resin 37 enclosed in a bag and separated from a catalyst is first installed in the inner part of the bore 33. Two or more such bags may be used if required. The bolt 32 is sufficiently flexible to enable it to be flexed through a right angle within the depth of the gallery as shown. It is fed into the bore 33 until it assumes a straight condition extending across the gallery. At this stage it has not penetrated the resin. The bolt is then coupled to a drilling machine by its head 29 and is simultaneously rotated and driven up into the bore. The bolt penetrates the resin and causes it to be mixed with catalyst. A clearance between the outer diameter of the bolt and the bore 33 helps to permit distribution of the resin down the bore around the bolt. The gaps 13 (FIG. 1) between outer wires of the strand of the bolt also allow resin to impregnate effectively into the interior of the strand to bond with the core wire as well as with a large surface area of the outer wires. The deformations in the outer wires assist in providing an effective anchorage of the wires to the resin. A strand diameter of 23.5 mm has been found to be satisfactory in a bore of 27 mm internal diameter.

The degree of flexibility required for the bolt 32 to enable it to be curved as shown is made possible in a relatively large diameter bolt by employing strand instead of bar for the bolt. The bolt also requires some rigidity and to be straight for the final rotating and driving operation. Use of low relaxation strand helps recovery of straightness after the bending of the bolt. The bending of the bolt on insertion should be within its elastic limit. Use of strand with a left hand lay for right hand rotation (or vice versa) can help to tighten the wires of the strand together and improve the stiffness and straightness of the strand as it is being driven.

Strand is normally manufactured from wire in a straight condition in continuous lengths and is then wound into coil for easy transport and storage. Strand with low relaxation properties provided by a warm stretching operation are also normally wound into coil. Strand from coil normally retains a small curvature on release from the coiled state 10 mm deflection from straight in a 1 m length is acceptable in most applications and is not unusual.

Greater straightness is generally required with the present invention because curvature can cause the strand to jam in its bore during insertion. One way of achieving the required straightness is to feed the strand through a set of straightening rolls and another is to temporarily reverse bend the strand. However, it is preferable for large scale production to cut freshly manufactured straight strand into suitable lengths without ever coiling it and manufacturing bolts from the unbent material.

A shorter lay length than the 12 to 18 diameters which is conventional for strand may also improve stiffness for driving purposes. A lay length of 8 diameter or between 6 and 12 diameters may prove beneficial. Alternatively a larger than conventional lay length may be employed to reduce elongation of the strand under load.

Effective load transfer between the bolt and surrounding rock is an important feature of a mine roof support bolt. The interlocking of the strand itself with the bonding agent and the interlock caused by the indented surface of the outer wires are both important in this load transfer. In a laboratory experiment with the strand described above, a 350 mm bond length has proved to be stronger than the tensile strength of the strand in that the strand fractured rather than pulling out of its anchorage.

Mine roof applications are generally passive in that no load arises on the bolt until some movement in the rock occurs. In some mining applications a partially active arrangement may be employed. In such a case the head arrangements should be such that the bolt can be tensioned against plate 28 after allowing a time interval for the resin to cure. For example a threaded sleeve may be welded, brazed or bonded by resin to the strand so that a nut can be run along the sleeve to provide tension. The nut may be temporarily secured to the sleeve by a limited torque connection to provide the driving head on insertion of the bolt. The torque required to free the nut then serves as a test that the resin has cured. Alternatively one fixed nut may provide the driving head and a separate nut then provides for tensioning.

The strand may also be used in fully active applications where the strand is pretensioned. In many civil engineering applications, strand is pretensioned to its normal working load, typically 70% of its breaking strength.

When used on a rock bolt or other anchorage, the plate 28 and nut 29 are replaced by a termination suitable for the application. In many cases at least one of the anchorages requires a facility for applying tension to the strand.

We claim:

1. An anchorage in rock of a high tensile strand, the strand comprising a core wire and a ring of outer wires, each outer wire being arranged in a helical pattern around the core wire and contacting the core wire along a length of each outer wire, the strand being located in a bore formed in the rock and the strand being anchored therein by a bonding agent, the strand being fitted within the bore with a clearance sufficient to permit easy insertion of the strand and to allow flow of bonding agent therearound;

wherein the diameter of the core wire is between 5% and 50% greater than the diameter of the outer wires and sufficient gaps are provided between adjacent outer wires by which a bonding agent impregnates into the strand through the gaps between adjacent outer wires for securing the stand within a bore formed in the rock.

2. An anchorage in rock as claimed in claim 1 wherein the strand is in the form of a 7-wire strand having a core wire and six equal diameter outer wires.

3. An anchorage in rock as claimed in claim 1 wherein the strand is in the form of a high tensile strand made up of a core wire and five outer wires.

4. An anchorage in rock as claimed in claim 1 wherein the strand is in the form of a high tensile strand wherein the outer wires have surface deformations.

5. A method of installing an anchorage as claimed in claim 1 as a mine roof support including the step of feeding the strand into the bore from a generally horizontal position by flexing the strand as it enters the bore.

6. A method as claimed in claim 5 wherein the flexing is within the limit of elasticity of the strand.

7. A method as claimed in claim 5 wherein the anchorage is rotated during the final part of insertion, in a direction such as to tend to tighten the outer wires of the strand on to the core wire.

8. An anchorage in rock of a high tensile strand, the strand comprising a core wire and a plurality of outer wires, each outer wire being arranged in a helical pattern around the core wire and contacting the core wire along a length of each outer wire, a bore being formed in the rock, the bore being closed at one end and being opened at the opposite end, and the strand being insertable into the bore with sufficient clearance to permit insertion of the strand therein;

wherein a bonding agent is provided within the bore adjacent the closed end thereof and, upon sufficient insertion of the strand into the bore formed in the rock, a lead end of the strand contacts the bonding agent and causes the bonding agent to flow around and along the length of the strand, the diameter of the outer wires is sufficiently large and a spacing between adjacent outer wires is such that sufficiently wide gaps are provided between adjacent outer wires to facilitate flow and impregnation, by the bonding agent, around and along the strand via the gaps and thereby secure the strand within the bore.

* * * * *

UNITED STATES PATENT AND TRADEMARK OFFICE

CERTIFICATE OF CORRECTION

PATENT NO. : 5,749,681

DATED : May 12,1998

INVENTOR(S) : Jeffrey DOIDGE and Terence CASSIDY

It is certified that error appears in the above-identified patent and that said Letters Patent is hereby corrected as shown below:

Title Page, Section [30], replace "Feb. 25, 1995 with "Feb. 25, 1994".

Signed and Sealed this

Eighth Day of September, 1998

*Attest:*

*Attesting Officer*

Bruce Lehman

BRUCE LEHMAN

*Commissioner of Patents and Trademarks*